US006273760B1

(12) United States Patent
Wu

(10) Patent No.: US 6,273,760 B1
(45) Date of Patent: Aug. 14, 2001

(54) HYBRID CONNECTOR WITH AUDIO JACK

(75) Inventor: Kun-Tsan Wu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/454,940

(22) Filed: Dec. 2, 1999

(30) Foreign Application Priority Data

Oct. 21, 1999 (TW) ..... 88118245

(51) Int. Cl.[7] ..... H01R 24/12
(52) U.S. Cl. ..... 439/668
(58) Field of Search ..... 439/668, 669, 439/76.1, 78, 83, 108, 173, 174, 171, 629, 655, 947

(56) References Cited

U.S. PATENT DOCUMENTS 2,717,367 * 9/1955 Puerner ..... 439/668
4,037,913 * 7/1977 Deitch et al. ..... 439/668
4,978,310 * 12/1990 Shichida ..... 439/668 X
5,022,872 * 6/1991 Shichida ..... 439/668

* cited by examiner

*Primary Examiner*—Renee Luebke
(74) *Attorney, Agent, or Firm*—Wei Te Chung

(57) ABSTRACT

A hybrid connector with an audio jack comprises an elongate dielectric housing defining a number of grooves for receiving a number of terminals and a mating hole for accommodating a contact assembly. The contact assembly includes first and second contacts which each have a base, a resilient engaging finger extending forwardly/rearwardly from the base for electrical connection with a complementary connector, and a soldering arm rearwardly extending from the base. The soldering arms of the first and second contacts each form soldering surfaces on top and bottom sides thereof whereby the first and second contacts can be interchangeably assembled. The contact assembly further includes a third contact having a soldering arm bending rearwardly from a base thereof. The soldering arms of the contact assembly extend rearwardly out of the housing for mounting the hybrid connector on a circuit board such that a bottom of the hybrid connector is below a top surface of the circuit board.

4 Claims, 6 Drawing Sheets

HYBRID CONNECTOR WITH AUDIO JACK

BACKGROUND OF THE INVENTION

1. Field of the Invention

The present invention relates to a hybrid connector with an audio jack, and particularly to a hybrid connector with an audio jack which has exchangeable terminals.

2. Brief Description of the Prior Art

U.S. Pat. Nos. 4,937,404, 4,978,310, and 5,092,795 disclose conventional connectors. The prior art connector (shown in FIG. 6) comprises a dielectric housing 101, a metallic grounding shroud 500 enclosing the housing 101, a conductive grounding contact 200, a first contact 300 and a second contact 400.

The housing 101 includes a case 103 for receiving the contacts 200, 300 and 400 and a sleeve 102 forwardly projecting from the case 103 through which a complementary plug (not shown) is inserted. The U-shaped grounding shroud 500 forms a grounding leg 501 for grounding the complementary plug (not shown) and a pair of soldering fingers 502 outwardly extending. The grounding terminal 200 has a flat base 201, a grounding arm 203 upwardly depending from the base 201 and a soldering finger 202 rearwardly and horizontally extending from a middle rear edge of the base 201. The first contact 300 includes a flat base 301, a soldering finger 302 depending outwardly from a bottom edge of the base 301, and a longitudinal engaging arm 303 continuing forwardly from the base 301. The second contact 400 has an elongated base 401, a soldering finger 402 outwardly depending from a bottom edge of the base 401, and a longitudinal engaging arm 403 depending rearwardly from the base 401. The engaging arm 303 of the first contact 300 and the engaging arm 403 of the second contact 400 are laterally spaced from each other and cooperate for mating with the inserted complementary plug (not shown).

In assembly, the first contact 300 and the second contact 400 are respectively located at right and left interior sides of the case 103 of the housing 101. The grounding terminal 200 is forwardly inserted from a rear end of the housing 101. The shroud 500 is then engaged with the outside of the case 103. Furthermore, the soldering fingers 202, 302, 402 and 502 are disposed under a bottom surface of the housing 101 for mounting the connector onto a printed circuit board (not shown). The height from a top surface of the connector to the printed circuit board (not shown), therefore, cannot be reduced, making the connector unsuitable for lower profile applications.

Hence, an improved electrical connector is required to overcome the disadvantages of the prior art.

BRIEF SUMMARY OF THE INVENTION

A first object of the present invention is to provide a hybrid connector with an audio jack which has a pair of interchangable contacts.

A second object of the present invention is to provide a hybrid connector with an audio jack which has a minimized height above a printed circuit board.

To achieve the above objects, a hybrid connector with an audio jack comprises an elongate dielectric housing, a plurality of terminals and a contact assembly. The housing includes a plurality of grooves in middle and lateral ends thereof for receiving the plurality of terminals, and a mating hole disposed between a set of grooves at a lateral end of the housing and the balance of the plurality of grooves. The mating hole extends from a front surface to a rear surface of the housing and accommodates the contact assembly.

The contact assembly includes a first contact, a second contact and a third contact, all of which have an axis of symmetry. The first contact has a resilient engaging finger extending forwardly from a base thereof and a soldering arm extending rearwardly from the base thereof. The soldering arm of the first contact forms soldering surfaces at a top and bottom thereof. The second contact has an elongate base, a soldering arm extending rearwardly from the base and a resilient engaging finger extending rearwardly from a front end of the base. The soldering arm of the second contact is identical with that of the first contact. The third contact includes a base, a soldering arm bending rearwardly from a top edge of the base for being welded on a circuit board, a securing wing extending forwardly from a bottom edge of the base, and a pair of resilient engaging fingers depending forwardly from lateral sides of the base. The engaging fingers of the first contact, the second contact and the third contact resiliently cooperate to establish electrical connection with an inserted complementary plug.

In assembly, the contact assembly is initially inserted into the mating hole. The first and second contacts are disposed in lateral insides of the mating hole and the third contact is disposed at a rear end of the mating hole. Because the soldering surfaces of the symmetric first and second contacts are symmetric, the first contact and the second contact can respectively be placed upside down and therefore be interchangeable in their positions. Furthermore, the soldering arms of the contact assembly cooperate with a pair of soldering pads mounted at lateral sides of the housing and are welded on the circuit board above a bottom of the housing thereby minimizing the height of a top surface of the hybrid connector above the circuit board.

Other objects, advantages and novel features of the invention will become more apparent from the following detailed description of the present embodiment when taken in conjunction with the accompanying drawings.

DETAILED DESCRIPTION OF THE INVENTION

Figures 1, 1A:
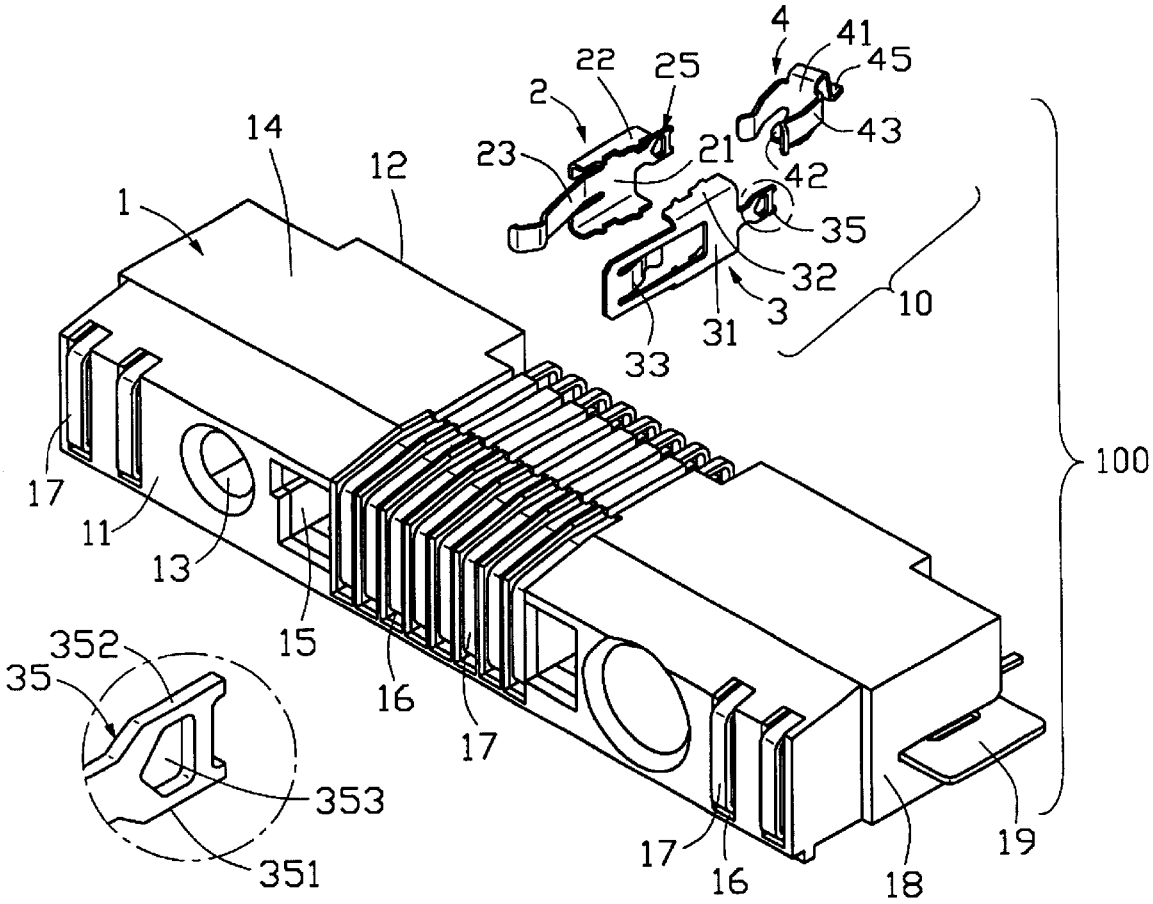
FIG. 1 is a partially assembled view of a hybrid connector of the present invention and a partial enlarged view of a rear end of one of contacts of the hybrid connector.
FIG. 1A is an enlarged perspective view of the solder arm of the second contact of FIG. 1.

Referring to FIG. 1, a hybrid connector 100 with an audio jack in accordance with the present invention comprises an elongated insulating housing 1, a plurality of terminals 17, a metallic contact assembly 10 accommodated in the housing 1, and a pair of soldering pads 19.

The housing 1 defines a top surface 14, a front surface 11 and a rear surface 12 opposite the front surface 11, and opposite side surfaces 18. A plurality of grooves 16 for receiving a plurality of terminals 17 is located in the middle and at lateral ends of the housing 1, each groove 16 extending through the housing 1 from the front surface 11 to the rear surface 12 and in communication with the top surface 14. A mating hole 13 is proximate to an end of the housing 1 and extends from the front surface 11 to the rear surface 12 for receiving the contact assembly 10 in a rear thereof and for receiving a complementary plug (not shown) from a front thereof. A positioning opening 15 is interposed between the plurality of grooves 16 and the mating hole 13 for fixing a positioning element of a complementary plug (not shown). A pair of soldering pads 19 (only one shown) laterally projects from a middle of the side surfaces 18 for mounting the hybrid connector 100 onto a printed circuit board 5 (see FIGS. 1 and 5).

The contact assembly 10 includes a first contact 2, a second contact 3 and a third contact 4 for cooperatively engaging with a complementary plug (not shown).

The first contact 2 is symmetric about a longitudinal axis and comprises a flat base 21, a pair of securing wings 22 inwardly and horizontally depending from the base 21, an engaging finger 23 extending forwardly from the base 21, and a soldering arm 25 extending rearwardly from the base 21. The base 21, the engaging finger 23 and the soldering arm 25 are essentially in a vertical plane. The resilient engaging finger 23 inwardly protrudes for mating with the complementary plug (not shown). The soldering arm 25 defines a hole 253 and forms identical soldering surfaces 251 and 252 on top and bottom surfaces thereof. The symmetric first contact 2 is thus adapted to be soldered on a circuit board 5 with the soldering surface 251 or 252 (see FIGS. 2 and 3).

Figure 2:
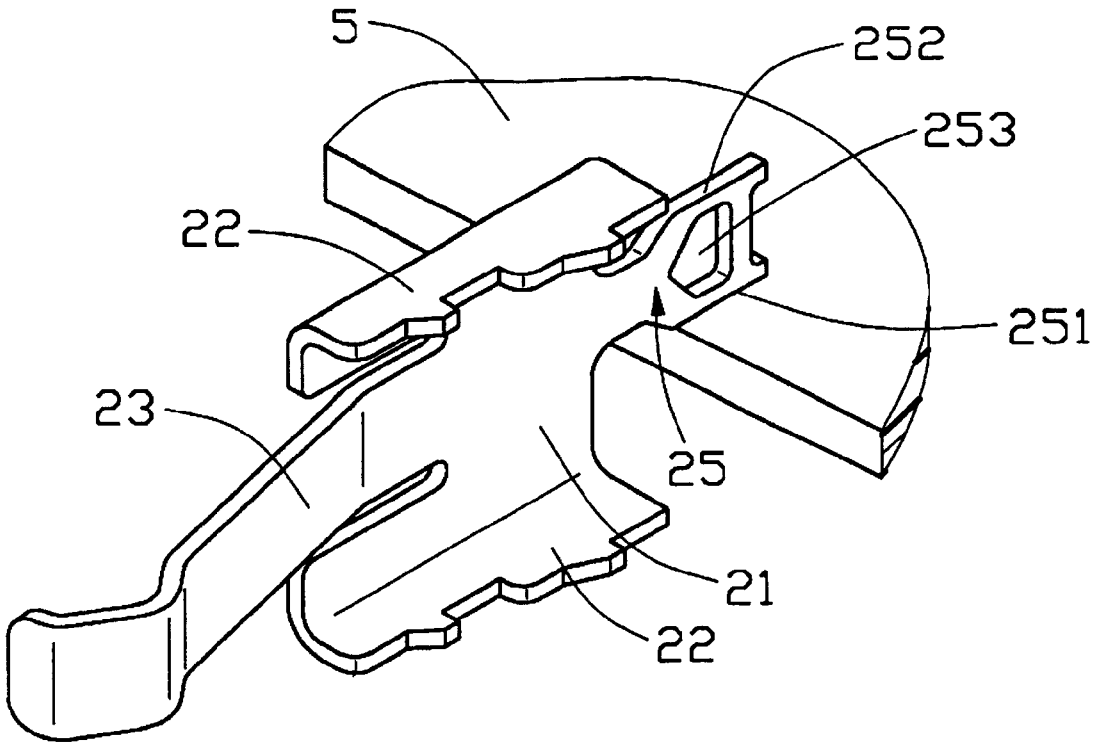
FIG. 2 is a perspective view of one of the contacts of FIG. 1 mounted on a printed circuit board in one position.
Figure 3:
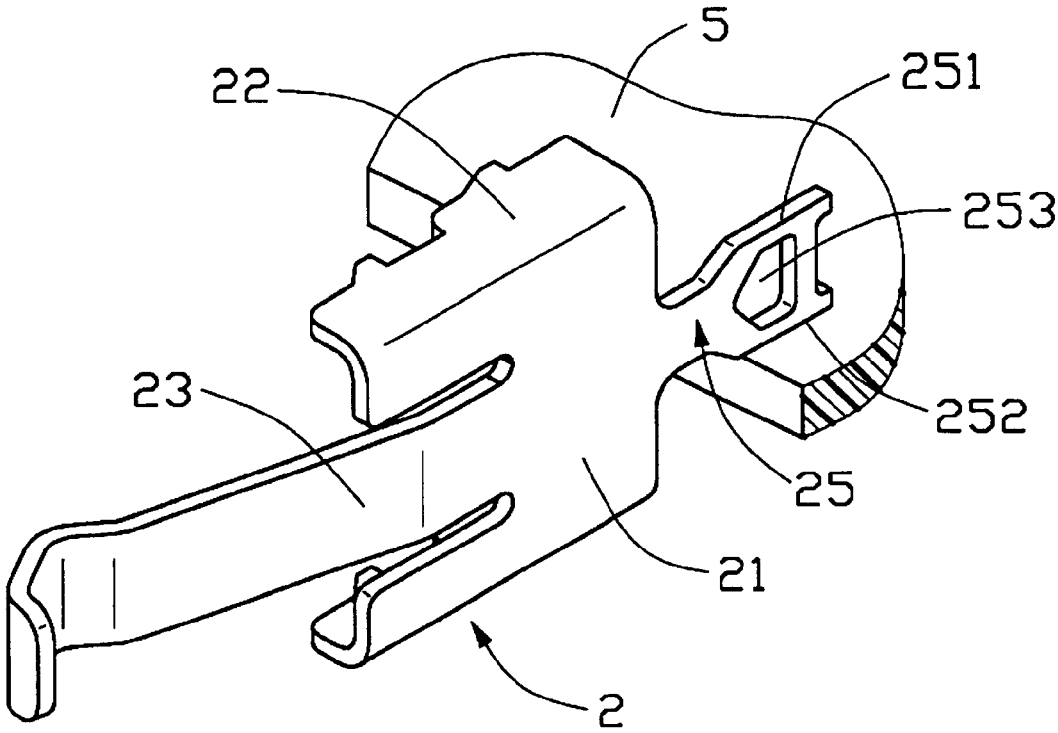
FIG. 3 is similar to FIG. 2 but with the contact mounted in a second position.

The second contact 3 includes an elongated flat base 31, a pair of securing wings 32 depending inwardly from top and bottom of the base 31, an engaging finger 33 extending rearwardly from a forward end of the base 31, and a soldering arm 35 rearwardly extending from the base 31 for being welded on the circuit board 5 (see FIGS. 2 and 3). The base 31, the engaging finger 33, and the soldering arm 35 of the second contact 3 are essentially in a vertical plane which is parallel to the plane of the first contact 2. The engaging finger 33 is stamped from the base 31 and inwardly protrudes for engaging with the complementary plug (not shown). The soldering arm 35 defines a hole 353 (see partial enlarged view in FIG. 1A) and forms symmetrical soldering surfaces 352 and 351 on top and bottom surfaces thereof. The symmetric second contact 3 is adapted to be slodered on a circuit board 5 with either the soldering surface 351 or the soldering surface 352, thereby allowing it to be placed in one orientation or another upside down orientation. Thus, the soldering arm 35 cooperates with the soldering arm 25 when soldered on the circuit board 5. (see FIGS. 1, 2 and 3).

The third contact 4 includes a base 41, a soldering arm 45 bending rearwardly from a top edge of the base 41 for being welded on the circuit board 5, a pair of resilient engaging fingers 43 depending forwardly from lateral edges of the base 41 and slightly projecting inwardly for contacting the complementary plug (not shown), and a securing wing 42 depending forwardly from the base 41.

Figure 4:
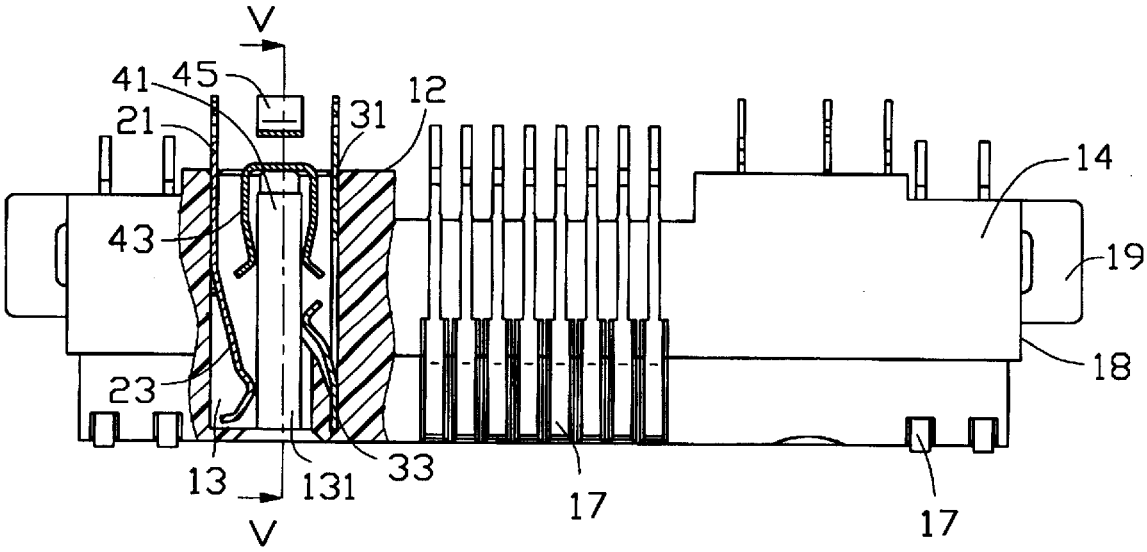
FIG. 4 is a top assembled view of the hybrid connector of FIG. 1 with a partial sectional view of the contacts of FIG. 1.
Figure 5:
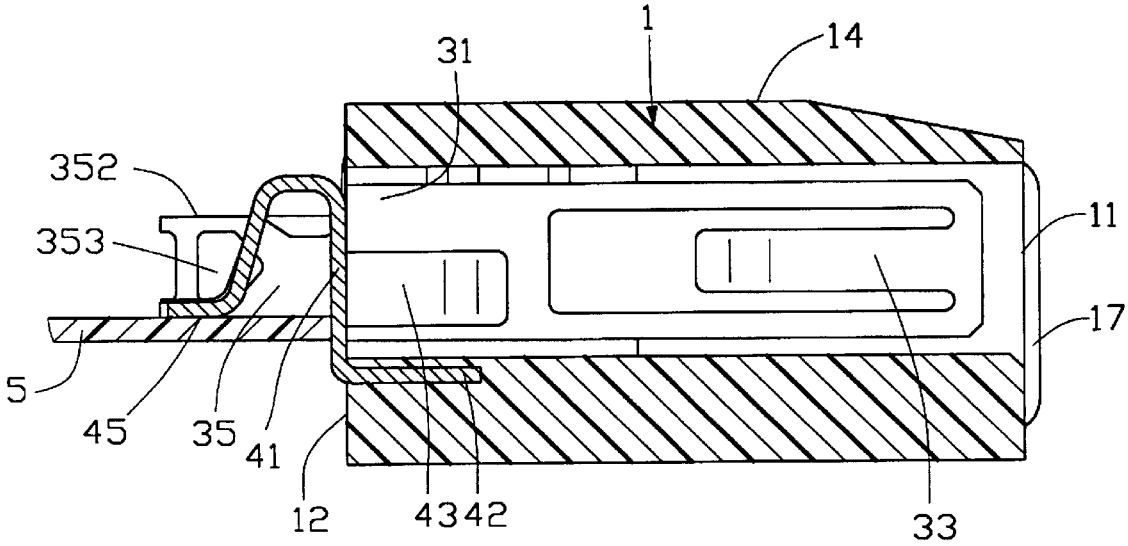
FIG. 5 is a side sectional view of the hybrid connector of FIG. 4 along line V—V.
Figure 6:
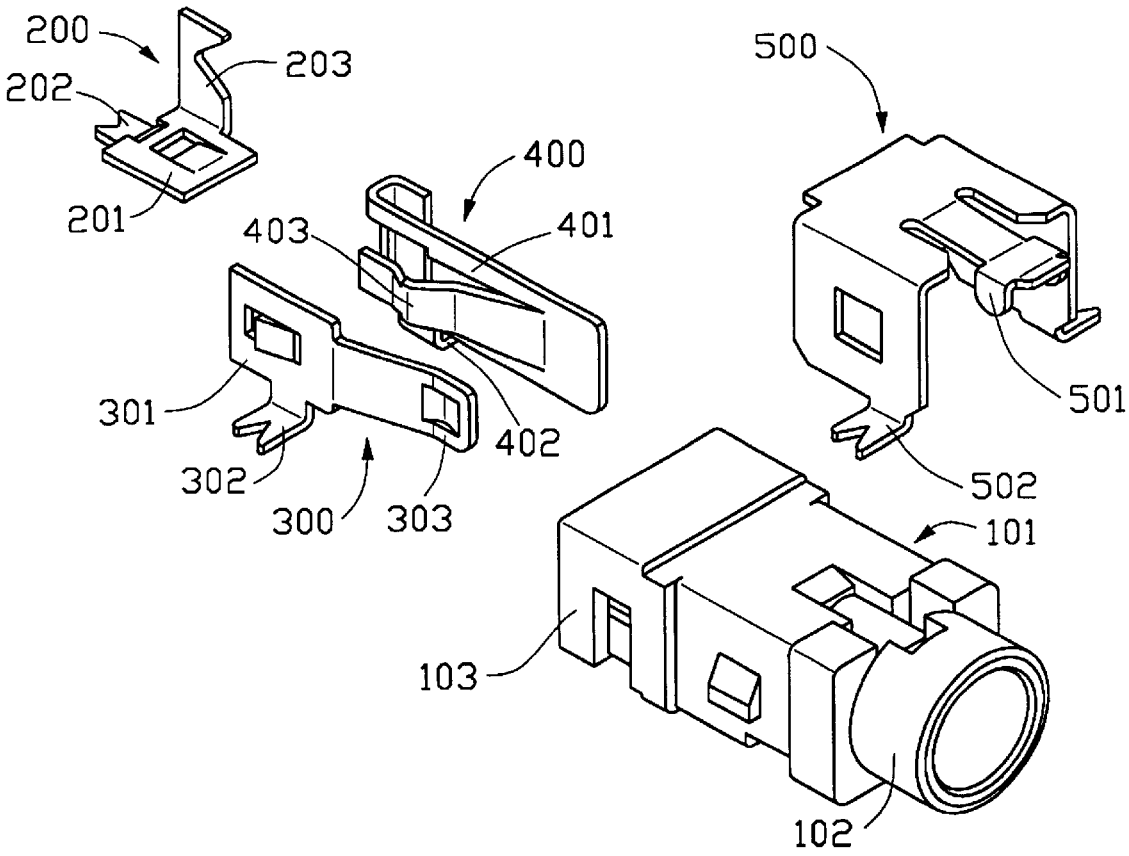
FIG. 6 (PRIOR ART)
FIG. 6 is an exploded view of a prior art audio jack.

Further referring to FIGS. 4 and 5, in assembly, the plurality of terminals 17 are received in the plurality of grooves 16. The first and second contacts 2 and 3 fit against lateral interior sides of the mating hole 13 while the soldering arms 25 and 35 extend rearwardly out of the housing 1. The securing wings 22, 32 of the first contact 2 and second contact 3 respectively interferentially fit with the interior sides of the mating hole 13, securing each contact therein. The third contact 4 interposes between the first and second contacts 2, 3 at a rear end of the mating hole 13 and the soldering arm 45 thereof extends rearwardly from a rear of the housing 1. A recess 131 of the mating hole 13 is located between the inserted contacts 2, 3 for guiding the complementary plug (not shown). The soldering surfaces 251, 351 of first and second contacts 2, 3 are coplanar with soldering surfaces of the soldering pads 19 and the soldering arms 45 of the third contact 4, therefore the hybrid connector 100 can be soldered on a top surface of the circuit board 5, which is above a bottom of the housing 1. Thus, a height from the top surface 14 of the hybrid connector 100 to the circuit board 5 is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric member;

a first contact having a base secured in the dielectric member, an engaging finger extending from the base for engaging with a mated complementary plug, and a soldering arm extending from the base and forming a pair of top and bottom soldering surfaces, the soldering arm forming a first longitudinal central line horizontally along a middle thereof and being symmetric about the first longitudinal central line;

a second contact having a base secured in the dielectric member, an engaging finger extending from the base for engaging with the mated complementary plug, and a soldering arm extending from the base and forming a pair of top and bottom soldering surfaces, the soldering arm forming a second longitudinal central line horizontally along a middle thereof and being symmetric about the second longitudinal central line; and a third contact having a base, a securing portion extending from the base and secured in the dielectric member, a pair of engaging fingers depending from the base, and a soldering arm depending from the base, the soldering arm being coplanar with the bottom surfaces of the soldering arms of the first and the second contacts.

2. The connector as claimed in claim 1, wherein said first and second contacts are respectively symmetric about the first and second longitudinal central lines.

3. The connector as claimed in claim 1, wherein said soldering arms extend out of the housing at a level above a bottom of the housing.

4. An electrical connector comprising:

a dielectric member defining a mating hole extending in a front-to-back direction thereof;

a first contact received in the mating hole, said first contact including a first vertical base retained to the housing with a first engaging finger forward extending therefrom and a first vertical soldering arm rearward extending therefrom;

a second contact received in the mating hole and being spatially opposite to the first contact, said second contact including a second vertical base retained in the housing with a second engaging finger extending in front of the second base and a second vertical soldering arm extending rearward from the second base; and a third contact received within the mating hole and positioned between said first contact and said second contact, said third contact defining a pair of third engaging fingers behind said first and second engaging fingers, and a third soldering arm between said first and second soldering arms and coplanar with bottom surfaces of the soldering arms of the first and the second contacts.

* * * * *